United States Patent [19]

Finney

[11] 4,269,545

[45] May 26, 1981

[54] RETAINING WALL STRUCTURE AND METHOD OF CONSTRUCTING SAME

[76] Inventor: William C. Finney, 1616 Walnut Cove Rd., Edmond, Okla. 73034

[21] Appl. No.: 58,517

[22] Filed: Jul. 18, 1979

[51] Int. Cl.[3] ..... E02D 5/06

[52] U.S. Cl. ..... 405/285; 256/19; 405/284

[58] Field of Search ..... 405/284, 285, 286, 15–21, 405/262, 273, 258; 256/19

[56] References Cited

U.S. PATENT DOCUMENTS

| | | | |
|---|---|---|---|
| 1,213,188 | 1/1917 | Hahn | 256/19 UX |
| 1,693,311 | 11/1928 | Miller et al. | 405/285 |
| 2,574,711 | 11/1951 | Rose | 256/19 |
| 2,641,448 | 6/1953 | Duke | 256/19 X |
| 2,695,159 | 11/1954 | Bridwell | 256/19 |
| 2,898,090 | 8/1959 | Rasmussen | 256/19 X |
| 3,114,244 | 12/1963 | Silver | 405/285 |
| 3,802,205 | 4/1974 | Dickinson | 405/285 |

FOREIGN PATENT DOCUMENTS

| | | | |
|---|---|---|---|
| 25115 | 11/1935 | Australia | 256/19 |
| 767562 | 2/1957 | United Kingdom | 256/19 |

*Primary Examiner*—Dennis L. Taylor

*Attorney, Agent, or Firm*—Laney, Dougherty, Hessin & Beavers

[57] ABSTRACT

A modular retaining wall structure comprises preformed reinforced concrete beams assembled with vertical post members to form the load supporting portion of the retaining wall. Portions of reinforcing bars extending from the beams engage the post members. Decorative coverings and integral fence structures are provided. Methods of constructing the retaining wall structure are also included.

15 Claims, 15 Drawing Figures

RETAINING WALL STRUCTURE AND METHOD OF CONSTRUCTING SAME

BACKGROUND OF THE INVENTION

1. Field of the Invention

This invention relates generally to wall structures and methods of constructing the same, and more particularly, but not by way of limitation, to modular retaining wall structures which are assembled out of preformed components.

2. Description of the Prior Art

The prior art includes various retaining walls, or similar structures, which are assembled out of preformed components. These are exemplified by U.S. Pat. Nos. 2,880,588 to Moore, 1,761,614 to Collier, 996,843 to Francisco, and 829,397 to Gerber.

Although the prior art has realized the need for retaining walls which may be assembled out of preformed components, it does not appear to include such a structure suitable for residential use. A structure designed for residential home use must be both economical and attractive. Preferably it has an appearance similar to conventional stone or timber retaining walls conventionally used in residential construction.

SUMMARY OF THE INVENTION

A retaining wall structure is provided which includes a plurality of stackable beam elements which are assembled with a plurality of spaced vertical post members to form the load-bearing portion of the retaining wall structure. Additionally, means are provided for attaching esthetically pleasing coverings to the exposed portion of the retaining wall structure to give it the appearance of a conventional stone or timber retaining wall.

It is, therefore, a general object of the present invention to provide an improved wall structure and method of constructing the same.

Another object of the present invention is the provision of a retaining wall structure which may be assembled out of preformed components.

Yet another object of the present invention is the provision of a retaining wall structure which, while assembled out of preformed concrete load-bearing beams, has an appearance similar to a conventional stone or timber wall.

And another object of the present invention is the provision of a retaining wall structure including a plurality of vertically spaced posts with load-bearing beams located therebetween, with reinforcing members of the load-bearing beams extending from the ends thereof to engage the vertical post members and transfer lateral loads to the post members.

Other and further objects, features and advantages of the present invention will be readily apparent to those skilled in the art upon a reading of the description of preferred embodiments which follows, when taken in conjunction with the accompanying drawings.

DETAILED DESCRIPTION OF THE PREFERRED EMBODIMENTS

Figure 1:
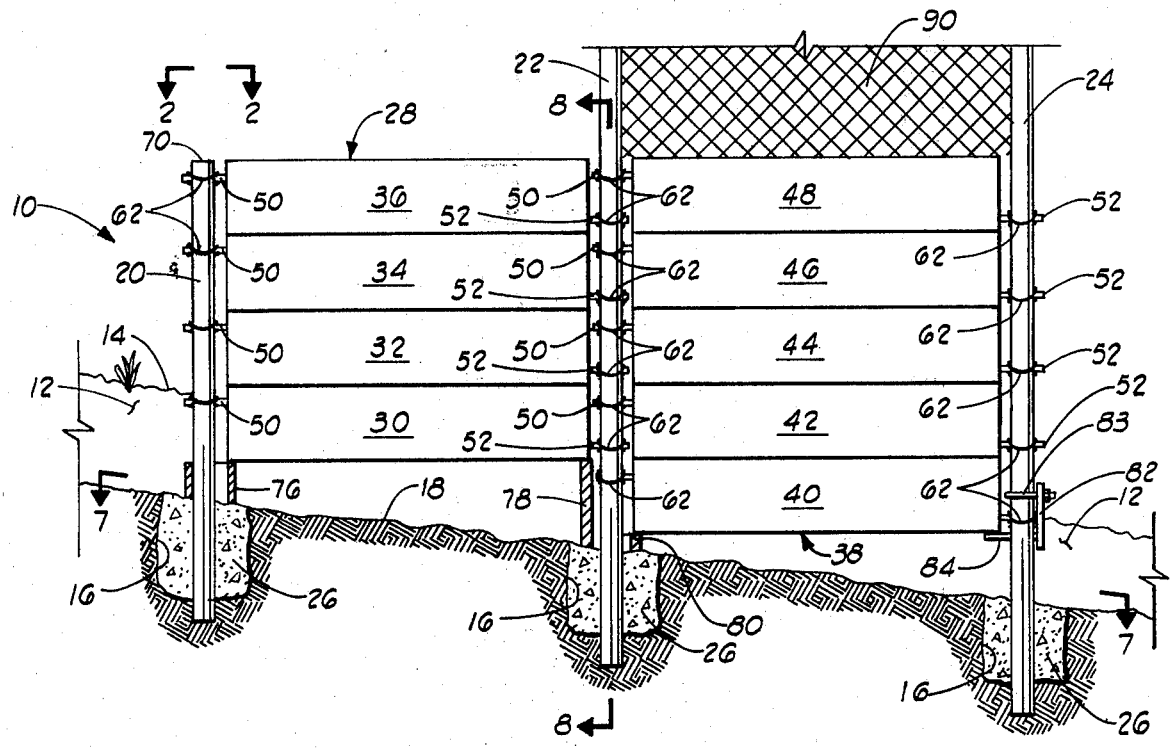
FIG. 1 is an elevation partly sectioned view of the load bearing components of the retaining wall structure of the present invention.

Referring now to the drawings and particularly to FIG. 1, the wall structure of the present invention, which in the disclosed embodiment is illustrated as a retaining wall, but which may also be a free-standing wall of a building or the like, is shown and generally designated by the numeral 10. The retaining wall structure 10 is constructed in the following manner.

First a trench 12 is dug in the surface 14 of the earth. Then a plurality of post holes 16 are dug extending below a bottom surface 18 of trench 12.

A plurality of spaced post members 20, 22 and 24 are then placed in post holes 16. The bottom ends of post members 20, 22 and 24 are driven into the soil below the bottom of post holes 16 and the post members are then aligned to a substantially vertical position. The post holes 16 are filled with concrete 26 which is allowed to harden thereby holding the post members 20, 22 and 24 in place.

Between the first and second post members 20 and 22, there is located a first stack 28 of reinforced preformed concrete beams. First stack 28 includes beams 30, 32, 34 and 36. Similarly, a second stack 38 of beams, located between second and third posts 22 and 24, includes beams 40, 42, 44, 46 and 48.

Figure 5A:
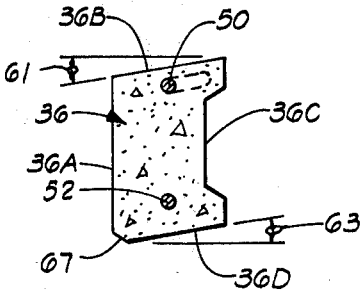
FIG. 5A is a cross-section view of the beam of FIG. 5, taken along line 5A—5A.
Figure 5:
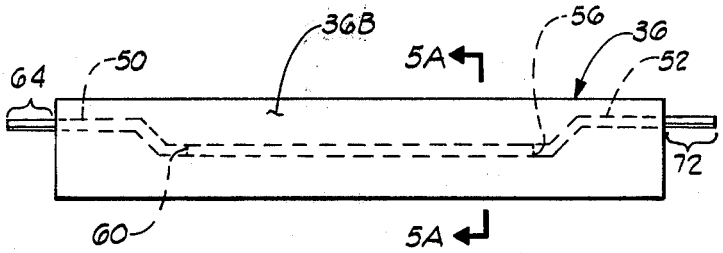
FIG. 5 is a plan view of a load bearing beam of the retaining wall structure of FIG. 1.
Figure 6:
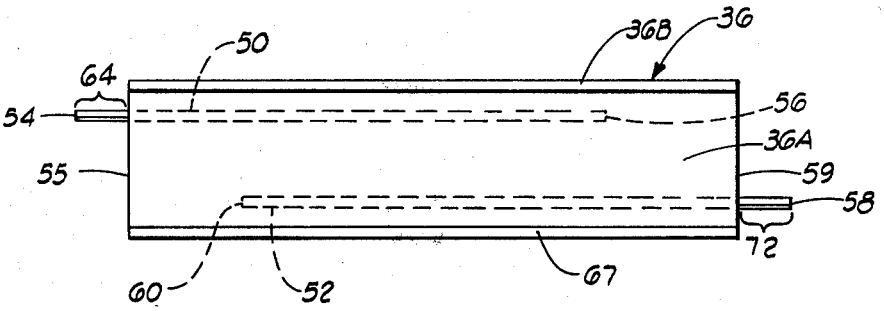
FIG. 6 is a front elevation view of the beam of FIG. 5.
Figure 7:
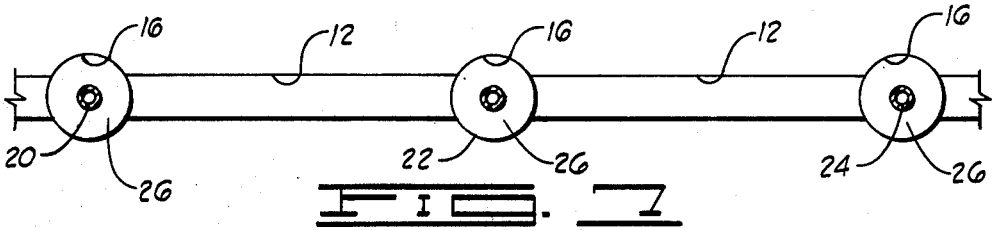
FIG. 7 is a sectional view of the retaining wall structure of FIG. 1 taken along line 7—7, primarily illustrating the layout of the trench and post holes.

Referring to FIGS. 5 and 6, plan and elevation views of a typical beam, such as beam 36, are there shown. Beam 36 includes upper and lower reinforcing bars 50 and 52 disposed therein.

Upper reinforcing bar 50 includes a first end 54 protruding from first end 55 of beam 36. upper reinforcing bar 50 includes a second end 56 embedded in concrete beam 36.

Similarly, lower reinforcing bar 52 includes a first end 58 and a second embedded end 60. First end 58 of lower reinforcing bar 52 protrudes from second end 59 of beam 36.

Referring now to FIG. 5A, a cross-section of beam 36 taken along line 5A—5A of FIG. 5 is shown. Beam 36 includes front, top, rear and bottom surfaces 36A, 36B, 36C and 36D, respectively.

Top and bottom surfaces 36B and 36D are sloped at angles 61 and 63, respectively, of approximately 15° from the horizontal.

Figure 8:
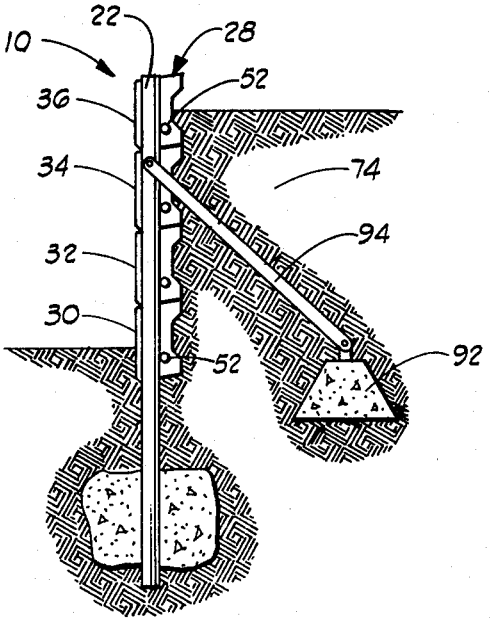
FIG. 8 is a sectional side elevation view taken along line 8—8 of FIG. 1, illustrating the retaining wall structure with an earthen embankment on one side thereof.

Rear surface 36C is channel shaped to conserve concrete material and provide a secure interface with an earthen embankment 74 (see FIG. 8).

Front and bottom surfaces 36A and 36D are joined by a beveled edge 67, which provides a parallel groove appearance between the beams when they are stacked.

As is best seen in FIG. 8, the bottom surface of beam 36 fits with the top surface of beam 34, and the bottom surface of beam 34 fits with the top surface of beam 32, etc. In this manner the beams of a given stack e.g. stack 28, are interlocked together when placed between two post members. Due to such interlock the guide means 62, described below, may often be deleted from intermediate beams, such as beams 32 and 34 of the stack 28.

Figure 2:
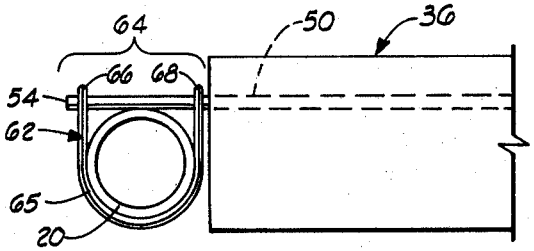
FIG. 2 is a plan view of a portion of the retaining wall structure of FIG. 1 taken about line 2—2.

The manner of engagement between beam 36 and the vertical posts, for example first post 20, is illustrated in FIG. 2 which is a plan view along line 2—2 of FIG. 1.

Figure 3:
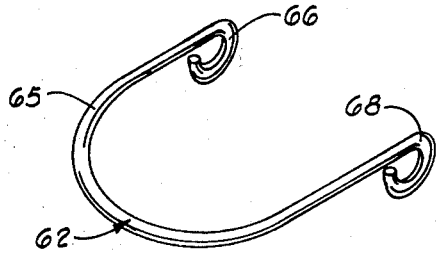
FIG. 3 is an oblique view of a guide means of the retaining wall structure of FIG. 1.

A guide means 62 is attached to an exposed portion 64 of upper reinforcing bar 50. Guide means 62 is best illusted in FIG. 3. Guide means 62 comprises a U-shaped loop portion 65 having first and second ends 66 and 68 which are connected to exposed portion 64 of upper reinforcing bar 50. The guide means 62 connects beam 36 to post member 20, and in combination with exposed reinforcing means portion 64, which may also be considered to be a portion of the guide means, prevents relative lateral movement between beam 36 and post member 20.

When beam 36 is assembled with post member 20, the guide means 62 is placed over an upper end 70 of post 20 to guide the first end 55 of beam 36 as it is lowered into place. A similar guide means 62 is connected to exposed end 72 of lower reinforcing bar 52.

As is shown in FIGS. 2 and 8, the beams 30, 32, 34 and 36 are arranged so that the reinforcing bars 50 and 52 engage first and second post members 20 and 22 on a side thereof adjacent an earthen embankment 74, so that a lateral load from the earthen embankment 74 is transferred to the first and second post members 20 and 22 through the exposed portions 62 and 72 of the upper and lower reinforcing bars 50 and 52, respectively.

When the lowermost beams 30 and 40 of each of the first and second stacks 28 and 38 are assembled with their respective post members, it is sometimes necessary to provide a support means under the lower beams to maintain them at the appropriate elevation prior to the time the trench 12 is backfilled with earth. FIG. 1 illustrates several examples of such support means.

A first support means 76 comprises a portion of plastic pipe placed over first post member 20 and spaced between the concrete mass 26 and the lower surface of beam 30.

A second form of support means merely comprises blocks placed under the beams. The ends of beams 30 and 40 adjacent second post 22 are supported by such blocks 78 and 80.

Figure 4:
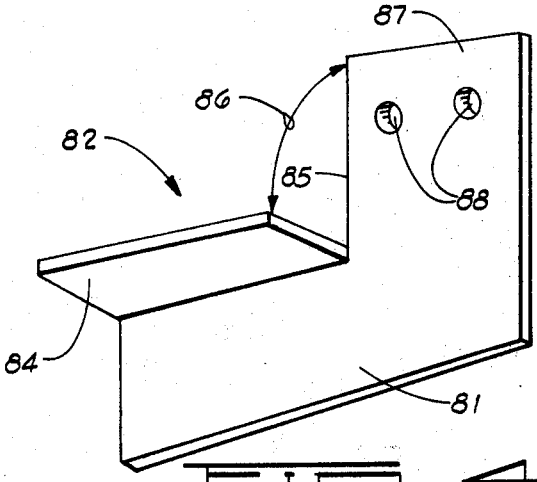
FIG. 4 is an oblique view of an angular bracket used to support one of the load bearing beams of the retaining wall structure of FIG. 1.

A third form of support means is shown supporting beam 40 from third post member 24. The third form of support means 82 shown in FIG. 1 is an angular bracket which is bolted to post member 24 by U-bolt means 83. As is best shown in FIG. 4, bracket 82 is formed from a rectangular metal sheet 81 having an ear 84 partially sheared therefrom along line 85 and bent at an angle 86 of approximately 75°. A vertical second ear 87 remains in the plane of sheet 81 and includes bolt holes 88 for connection of U-bolt 83. Two such clips 82 may be placed on opposite sides of post member 24 to support beams from both sides thereof.

As is best seen in FIG. 1, the lower reinforcing bars 52 of the beams 30, 32, 34 and 36 of first stack 28 are lower than the upper reinforcing bars 50 of adjacent beams 42, 44, 46 and 48, respectively, of second stack 38. In that manner the reinforcing bars of adjacent beams are staggered so that they will not interfere with each other.

It is sometimes desirable to provide a conventional fence located directly above a retaining wall. Such is easily provided by the retaining wall structure 10 as illustrated in FIG. 1. Post members 22 and 24 are shown to extend upward past uppermost beam 48 of second stack 38. A conventional fence 90 is then connected between the uppermost portions of posts 22 and 24 above the retaining wall.

Depending upon the height of the retaining wall structure 10, it may be desirable to provide additional lateral support to the post members by connecting them to an anchor 92 as shown in FIG. 8. The post member 22 is connected to anchor 92 by a conventional strap 94.

Figure 9:
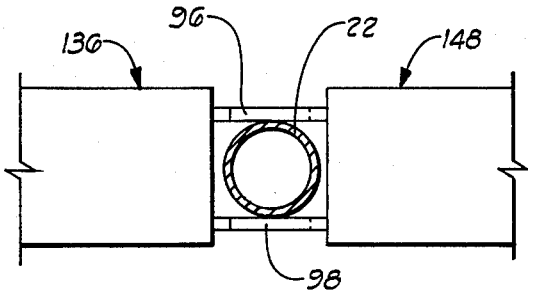
FIG. 9 is a plan view showing an alternative embodiment of the beams of the retaining wall structure assembled with a vertical post member.

Referring now to FIG. 9, an alternative embodiment of the beams of the present invention is there shown. FIG. 9 shows top beams 136 and 148, analogous to beams 36 and 48, respectively, connected to second post member 22. The difference in beams 136 and 148 is that rather than having a single reinforcing bar extending from each end thereof with a separate guide means attached thereto, the beams 136 and 148 each include two exposed portions of reinforcing bar extending parallel from each end thereof. The two exposed portions of reinforcing bar, for example bars 96 and 98 of beam 148, are parallel and are located on opposite sides of post member 22. These two parallel exposed portions in themselves provide a guide means for restricting lateral movement of the beam 148 so that the beam 148 may be placed over an upper end of post 22 to guide beam 148 into place upon post member 22.

Figure 10:
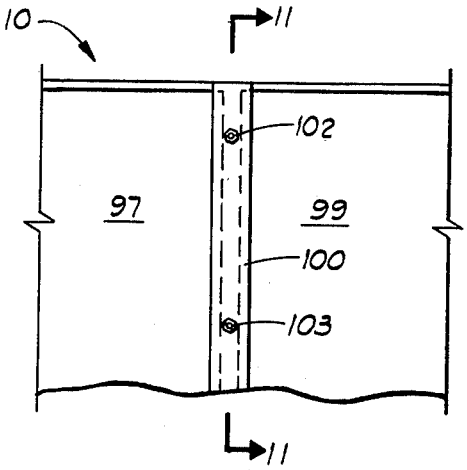
FIG. 10 is an elevation view illustrating one form of decorative covering for the retaining wall structure of FIG. 1.
Figure 11:
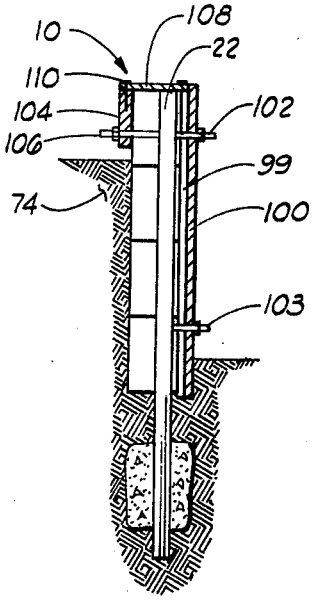
FIG. 11 is a sectional elevational view taken along line 11—11 of FIG. 10.

Referring now to FIG. 10, a first manner of providing a decorative covering for the retaining wall structure is illustrated. In FIGS. 10 and 11, panel type covers 97 and 99 are maintained, upon the side of the retaining wall structure opposite earthen embankment 74, by a retaining strip 100 attached to post member 22 by bolt means 102 and 103. A nailing strip 104 is similarly attached to the other side of retaining wall structure 10 by a bolt means 106. A top cover panel 108 is then attached to nailing strip 104 and covers 97 and 99 by nails 110. The panels 97 and 99 typically are a cedar-type outdoor board material.

Figure 12:
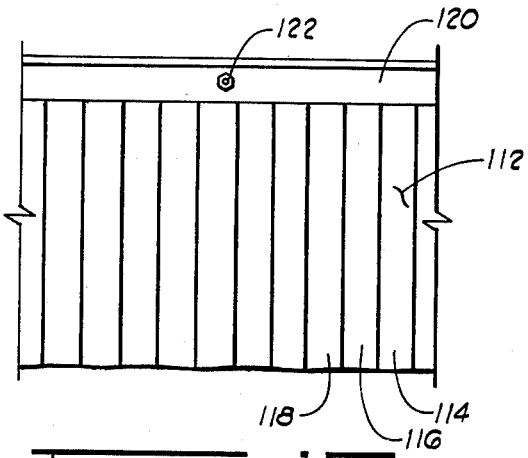
FIG. 12 is an elevation view of an alternative form of decorative covering for the retaining wall structure of FIG. 1.

Similarly, in FIG. 12 an alternative form of cover generally designated by the numeral 112 is illustrated. The cover 112 comprises a plurality of vertical planks 114, 116, 118, etc. held in place by a horizontal member 120 attached to a post by bolt 122.

Figure 13:
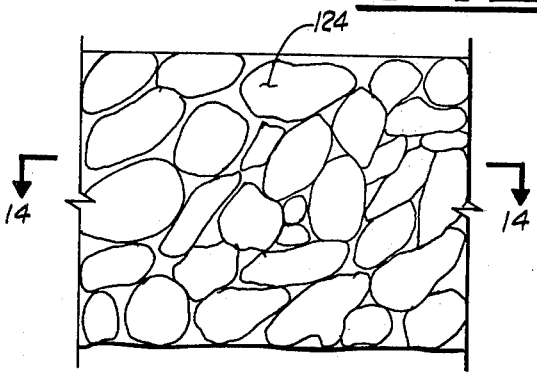
FIG. 13 is an elevation view of another form of decorative covering for the retaining wall structure of FIG. 1.
Figure 14:
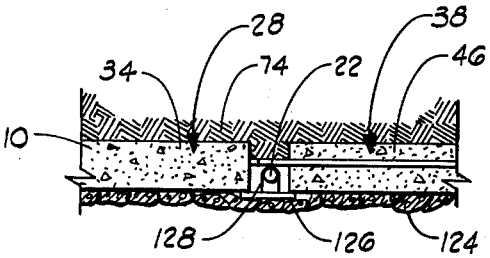
FIG. 14 is a sectional view taken along line 14—14 of FIG. 13.

A third form of decorative cover is illustrated in FIGS. 13 and 14. FIG. 13 is an elevation view of a rock type covering 124.

As is shown in FIG. 14, the space between the stacks 28 and 38 of beams is covered with a thin metal plate 126 which may be attached to post member 22 by wire 128 or other suitable means. Then the rock covering 124 is placed over the surface of retaining wall structure 10 opposite earthen embankment 74. The rock covering 124 may be formed of real rocks and mortar or may comprise a sheet of imitation rock-like material.

Thus, the retaining wall structure and method of constructing same of the present invention is well adapted to carry out the objects and attain the ends and advantages mentioned, as well as those inherent therein. While presently preferred embodiments of the present invention have been described for the purpose of this disclosure, numerous changes in the construction and arrangement of parts can be made by those skilled in the art, which changes are encompassed within the spirit of this invention as defined by the appended claims.

What is claimed is:

1. A wall structure comprising:

first and second spaced post members;

a plurality of beams stacked one upon the other to form a wall, a first one of said plurality of beams being further characterized as a first preformed concrete beam having reinforcing means disposed therein with first and second reinforcing means portions extending from first and second ends of said first beam, said first beam being located between said first and second post members with said first and second exposed reinforcing means portions engaging said first and second post members, respectively; and a first guide means for restricting lateral movement of said first beam relative to said first post member when said guide means is placed over an upper end of said first post member and for thereby guiding said first end of said first beam into place as said first beam is lowered relative to said first post member.

2. The wall structure of claim 1, wherein said guide means comprises a U-shape loop having first and second ends connected to said first exposed reinforcing means portion.

3. The wall structure of claim 1, wherein said reinforcing means includes first and second vertically spaced reinforcing bars each having an end extending from said first and second ends, respectively, of said first beam to form said first and second exposed reinforcing means portions, respectively.

4. The wall structure of claim 1, wherein said first beam includes front, top, rear and bottom surfaces, said top and bottom surfaces being sloped at an acute angle to the horizontal so that the top surface of said first beam is co-extensive with a bottom surface of a similar second beam stacked on top of said first beam.

5. The wall structure of claim 4, wherein said rear surface is channel shaped.

6. A retaining wall structure comprising:

first and second spaced post members having lower ends thereof embedded in the earth;

a plurality of beams stacked one upon the other to form a wall, a first one of said plurality of beams being further characterized as a first preformed concrete beam having reinforcing means disposed therein with first and second exposed reinforcing means portions extending from first and second ends of said first beam, said first beam being located between said first and second post members with said first and second exposed reinforcing means portions engaging said first and second post members, respectively, so that a lateral load from an earthen embankment is transferred to said first and second post members through said first and second exposed reinforcing means portions; and a first guide means for restricting lateral movement of said first beam relative to said first post member when said guide means is placed over an upper end of said first post member and for thereby guiding said first end of said first beam into place as said first beam is lowered relative to said first post member.

7. The retaining wall structure of claim 6, wherein said first and second exposed reinforcing means portions engage said first and second post members on sides thereof adjacent said earthen embankment.

8. The retaining wall structure of claim 6, wherein said guide means comprises a U-shape loop having first and second ends connected to said first exposed reinforcing means portion of said first beam.

9. The retaining wall structure of claim 6, wherein said reinforcing means includes first and second vertically spaced reinforcing bars each having an end extending from said first and second ends, respectively, of said first beam to form said first and second exposed reinforcing means portions, respectively.

10. The retaining wall structure of claim 6, wherein:

said first and second post members extend upward past an uppermost beam of said wall; and said structure further comprises a fence connected between said first and second post members above said wall.

11. The retaining wall structure of claim 6, further comprising a cover means for covering a side of said wall opposite said earthen embankment, said cover being attached to one of said post members.

12. A retaining wall structure, comprising:

first, second and third spaced post members having lower ends thereof embedded in the earth;

a first stack of concrete beams located between said first and second post members, each of said beams of said first stack having upper and lower vertically spaced reinforcing bars disposed therein with end portions of said upper and lower reinforcing bars extending from first and second ends, respectively, of said beams, said end portions of said upper and lower reinforcing bars engaging said first and second post members, respectively, so that a lateral load from an earthen embankment is transferred to said first and second post members through said end portions of said upper and lower reinforcing bars; and a second stack of concrete beams located between said second and third post members, each of said beams of said second stack having upper and lower vertically spaced reinforcing bars disposed therein with end portions of said upper and lower reinforcing bars extending from first and second ends, respectively, of said beams of said second stack, said end portions of said upper and lower reinforcing bars of said beams of said second stack engaging said second and third post members, respectively, so that said end portions of said lower reinforcing bars of said beams of said first stack are located below said end portions of said upper reinforcing bars of adjacent beams of said second stack.

13. A method of constructing a retaining wall structure, said method comprising the steps of:

digging a trench;

setting first and second spaced post members having lower ends thereof extending into the earth below a bottom of said trench; and placing a preformed concrete beam, having first and second reinforcing means portions extending from first and second ends of said beam, respectively, between said first and second post members and at least partially within said trench with said first and second exposed reinforcing means portions engaging said first and second post members, respectively, so that a lateral load from an earthen embankment is transferred to said first and second post members through said first and second exposed reinforcing means portions, said step of placing said preformed concrete beam including steps of:

placing guide means of said first and second ends of said beam over upper ends of said first and second post members, said guide means including said first and second exposed reinforcing means portions;

then lowering said beam relative to said post members; and thereby guiding said beam into place between said post members; and placing a second preformed beam between said first and second post members, said second beam being located above said first beam.

14. The method of claim 13, further comprising the step of covering sides of said first and second beams, opposite said earthen embankment, within a cover attached to one of said post members.

15. The method of claim 13, further comprising a step of connecting a fence between upper ends of said first and second post members.

* * * * *